US008726562B1

(12) United States Patent
Hoskisson

(10) Patent No.: US 8,726,562 B1
(45) Date of Patent: May 20, 2014

(54) OPTICS MOUNT FOR A FIREARM

(76) Inventor: Scot Hoskisson, Bloomington, IN (US)

( * ) Notice: Subject to any disclaimer, the term of this patent is extended or adjusted under 35 U.S.C. 154(b) by 1 day.

(21) Appl. No.: 13/398,453

(22) Filed: Feb. 16, 2012

Related U.S. Application Data

(60) Provisional application No. 61/443,312, filed on Feb. 16, 2011.

(51) Int. Cl.
*F41G 1/00* (2006.01)

(52) U.S. Cl.
USPC ..... 42/135; 42/124; 42/126

(58) Field of Classification Search
USPC ..... 42/135, 125, 148, 136, 137, 138, 124, 42/126, 127, 128
See application file for complete search history.

(56) References Cited

U.S. PATENT DOCUMENTS

| | | | | |
|---|---|---|---|---|
| 2,425,130 | A * | 8/1947 | Shelley | 42/16 |
| 5,787,630 | A * | 8/1998 | Martel | 42/125 |
| 5,887,375 | A * | 3/1999 | Watson | 42/106 |
| 6,381,895 | B1 | 5/2002 | Keeney et al. | |
| 6,678,988 | B1 * | 1/2004 | Poff, Jr. | 42/147 |
| 6,722,075 | B1 * | 4/2004 | Gabaldon | 42/141 |
| 6,886,288 | B1 * | 5/2005 | Yocum et al. | 42/127 |
| 7,908,782 | B1 * | 3/2011 | LaRue | 42/128 |
| 8,020,335 | B2 * | 9/2011 | Larsson et al. | 42/125 |
| 8,024,884 | B2 * | 9/2011 | Holmberg | 42/124 |
| 8,161,674 | B2 * | 4/2012 | Holmberg | 42/90 |
| 8,327,574 | B2 * | 12/2012 | Sandler et al. | 42/126 |
| 2002/0162267 | A1 * | 11/2002 | Nelson et al. | 42/120 |
| 2007/0157503 | A1 * | 7/2007 | Holmberg | 42/124 |
| 2008/0000465 | A1 * | 1/2008 | Holmberg | 124/86 |
| 2008/0072471 | A1 * | 3/2008 | Keng | 42/124 |
| 2009/0205240 | A1 * | 8/2009 | Dextraze | 42/126 |
| 2010/0011649 | A1 * | 1/2010 | Holmberg | 42/124 |

OTHER PUBLICATIONS

The products shown in Attachment A hereto were on sale at least by Feb. 15, 2010.

* cited by examiner

*Primary Examiner* — Michelle Clement
(74) *Attorney, Agent, or Firm* — Austin Rapp & Hardman

(57) ABSTRACT

An optics mount for a firearm is disclosed. The optics mount includes a laterally adjustable member and a base member. The laterally adjustable member comprises a first engaging member and a scope bracket. The base member may comprises a side rail receptor shaped to engage a side rail mount of a firearm (or another type of engaging mechanism) and a second engaging member shaped to slidably engage the first engaging member in a lateral direction of the optics mount. In one configuration, the optics mount may also be repositioned in a longitudinal direction along the optics mount.

5 Claims, 15 Drawing Sheets

10
22
12
14
38
62
60
39
42
41
40
46
48
44

10
62
43
39
38
41
42
52
46
50
40
48
44
12
22
32
34
14
30
36

10
12
14
38
60
62
39
50
42
41
40
46
44
48
22

OPTICS MOUNT FOR A FIREARM

RELATED APPLICATIONS

The present application claims priority to U.S. provisional App. No. 61/443,312 filed on Feb. 16, 2011 and entitled Optics Mount for a Firearm, which is incorporated herein by this reference.

TECHNICAL FIELD

The present invention relates to an accessory for a firearm and, more specifically, relates to an optics mount for a firearm.

BACKGROUND

An optics mount together with a scope enable a user of a firearm to more easily target a remote object. However, the optics mount may interfere with disassembly of the firearm or may not enable lateral or longitudinal movement of the mount.

BRIEF SUMMARY

The following presents a simplified summary of the disclosed embodiments in order to provide a basic understanding of such embodiments. This summary is not an extensive overview of all contemplated embodiments, and is intended to neither identify key or critical elements nor delineate the scope of such embodiments. Its sole purpose is to present some concepts of the disclosed embodiments in a simplified form as a prelude to the more detailed description that is presented later.

An optics mount for a firearm is disclosed. The optics mount includes a laterally adjustable member and a base member. The laterally adjustable member comprises a first engaging member and a scope bracket. The base member may comprises a side rail receptor shaped to engage a side rail mount of a firearm (or another type of engaging mechanism) and a second engaging member shaped to slidably engage the first engaging member in a lateral direction of the optics mount. In one configuration, the optics mount may also be repositioned in a longitudinal direction along the optics mount.

To the accomplishment of the foregoing and related ends, one or more embodiments comprise the features hereinafter fully described and particularly pointed out in the claims. The following description and the annexed drawings set forth in detail certain illustrative aspects of the disclosed embodiments. These aspects are indicative, however, of but a few of the various ways in which the principles of various embodiments may be employed. Further, the disclosed embodiments are intended to include all such aspects and their equivalents.

BRIEF DESCRIPTION OF THE DRAWINGS

In order that the advantages of the invention will be readily understood, a more particular description of the invention briefly described above will be rendered by reference to specific embodiments that are illustrated in the appended drawings. Understanding that these drawings depict only typical embodiments of the invention and are not therefore to be considered to be limiting of its scope, the invention will be described and explained with additional specificity and detail through the use of the accompanying drawings, in which.

Figure 1:
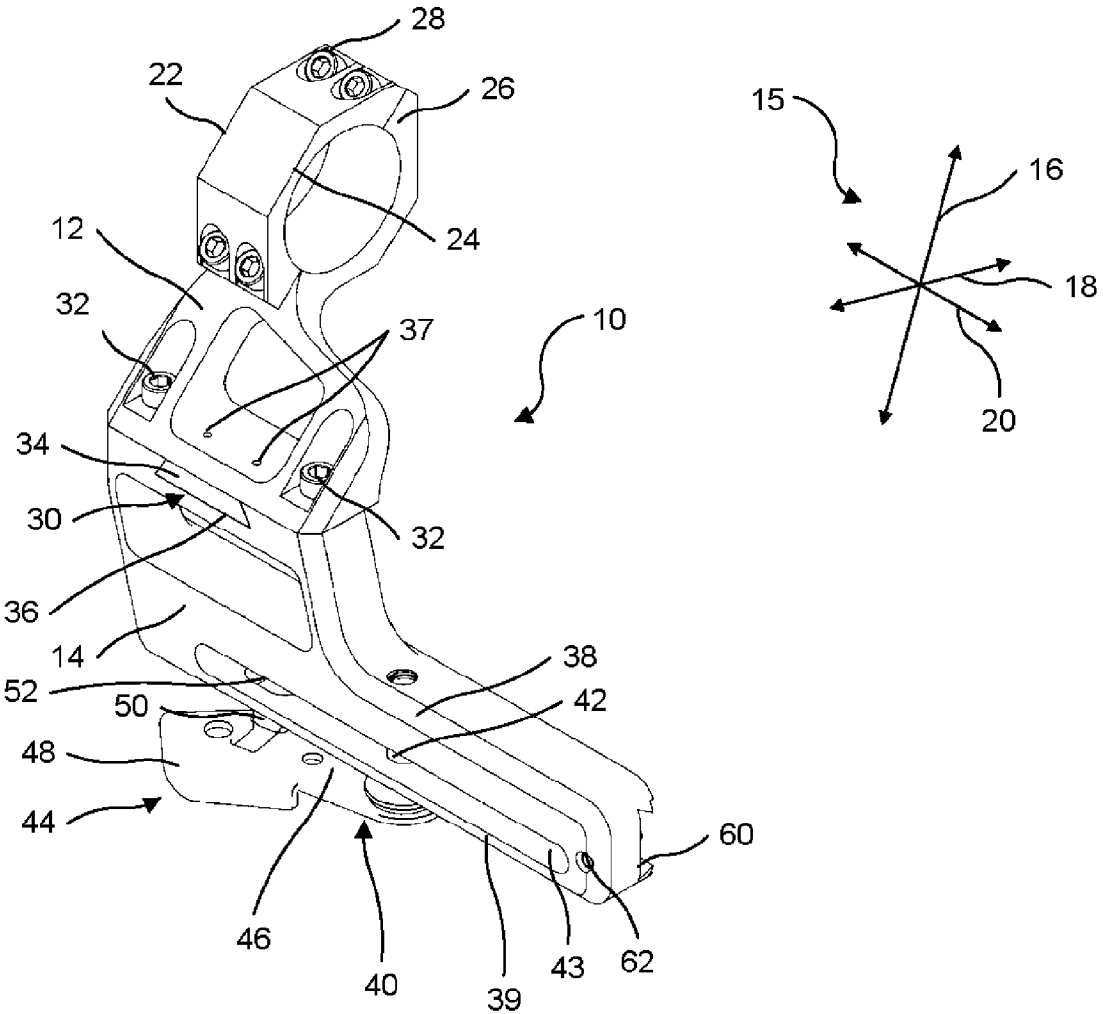
FIG. 1 is an elevated perspective view of one embodiment of an optics mount.

In accordance with common practice, the various features illustrated in the drawings may not be drawn to scale. Accordingly, the dimensions of the various features may be arbitrarily expanded or reduced for clarity. In addition, some of the drawings may be simplified for clarity. Thus, the drawings may not depict all of the components of a given apparatus (e.g., device) or method. Finally, like reference numerals may be used to denote like features throughout the specification and figures.

DETAILED DESCRIPTION

The presently preferred embodiments of the present invention will be best understood by reference to the drawings, wherein like parts are designated by like numerals throughout. It will be readily understood that the components of the present invention, as generally described and illustrated in the figures herein, could be arranged and designed in a wide variety of different configurations. Thus, the following detailed description of the embodiments of the present invention, as represented in the Figures, is not intended to limit the scope of the invention, as claimed, but is merely representative of presently preferred embodiments of the invention.

The word "exemplary" is used exclusively herein to mean "serving as an example, instance, or illustration." Any embodiment described herein as "exemplary" is not necessarily to be construed as preferred or advantageous over other embodiments. While the various aspects of the embodiments are presented in drawings, the drawings are not necessarily drawn to scale unless specifically indicated.

Reference to "an embodiment" or "one embodiment" in this disclosure refers to one or more features, structures, or characteristics of the disclosed device that may be combined with other features disclosed herein and is not limited to a specific iteration or configuration of the disclosed subject matter. Thus, appearances of the phrases "in one embodiment," "in an embodiment," and similar language throughout this specification may, but do not necessarily, all refer to the same embodiment.

FIG. 1 is an elevated perspective view of one embodiment of an optics mount 10. The illustrated optics mount 10 includes a laterally adjustable member 12 and a base member 14. A key 15 in FIG. 1 illustrates a transverse direction 16, a lateral direction 18, and a longitudinal direction 20 of the optics mount 10.

The laterally adjustable member 12 may be adjusted in a lateral direction 18 with respect to the base member 14. This lateral adjustment is enabled via an interlocking mechanism 30. The interlocking mechanism 30 includes a male dovetail member 34 (which may be referred to as a first engaging member) and a female dovetail member 36 (which may be referred to as a second engaging member). The male dovetail member 34 and the female dovetail member 36 interlock in sliding engagement to allow movement of the laterally adjustable member 12 relative to the base member 14.

Figure 6A:
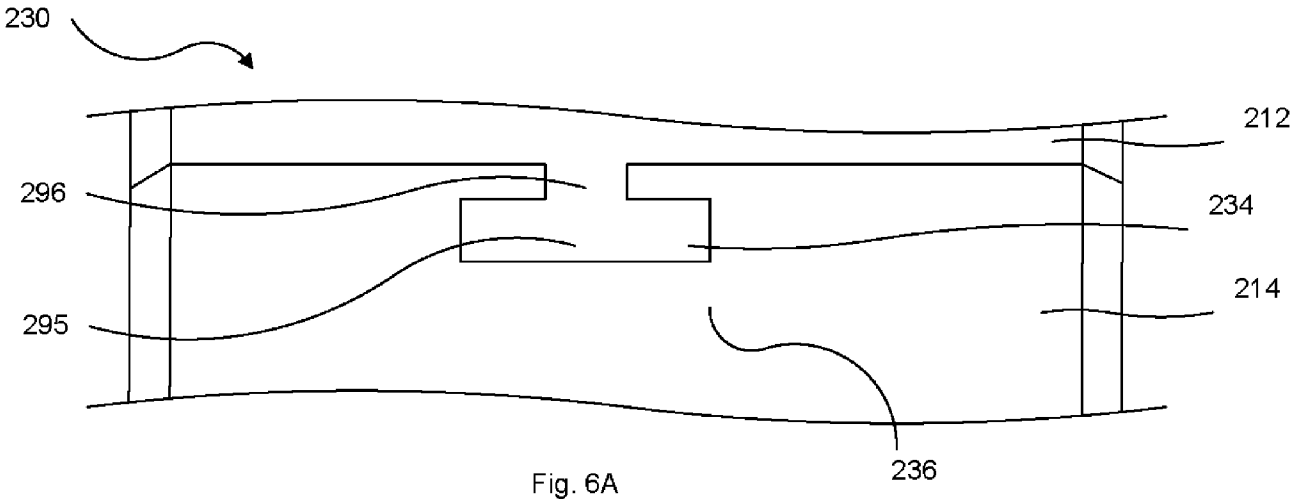
FIGS. 6A and 6B are partial views of optics mounts showing alternative embodiments of interlocking mechanisms that enable slidable engagement between a base member and a laterally adjustable member.
Figure 6B:
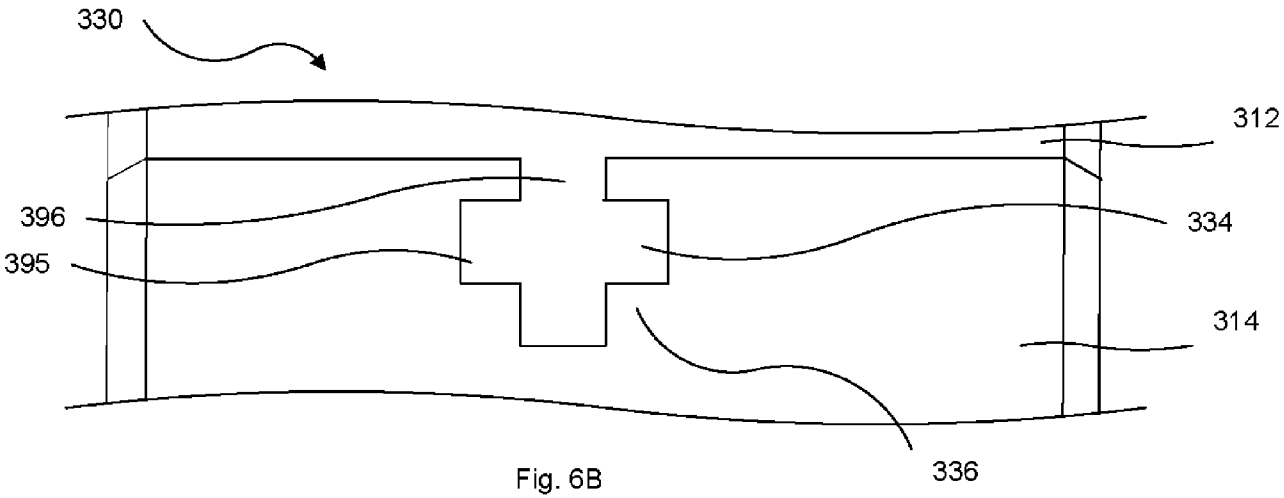

Other shapes beyond the dovetail shape illustrated in FIG. 1 may be utilized within the scope of the disclosed subject matter to enable the laterally adjustable member 12 and base member 14 to interlock in slidable engagement. For example, the interlocking dovetails may have mating curves rather than linear edges. Also, as illustrated in FIGS. 6A and 6B, in certain embodiments, an interlocking mechanism 230, 330 may comprise a male member 234, 334 (which may be referred to as a first engaging member) having a broad head 295, 395 and a narrow stem 296, 396 (such as a T-shaped member 234 of FIG. 6A or a plus-shaped member 334 of FIG. 6B) with a corresponding mating female member 236, 336 (which may be referred to as a second engaging member) to enable sliding engagement between the adjustable member 212, 312 and the base member 214, 314.

Returning to FIG. 1, lateral direction locking screws 32 may be rotated to fix the position of the laterally adjustable member 12 relative to the base member 14. The number of lateral direction locking screws 32 may be varied within the scope of this invention. For example, in an alternative embodiment, three lateral direction locking screws 32 may be utilized.

Other locking mechanisms may be utilized within the scope of the disclosed subject matter to fix the position of the laterally adjustable member 12 relative to the base member 14. For example, the laterally adjustable member may include divots 37, as illustrated in FIG. 1. The divots 37 serve as starts or guides to enable drilling in a transverse direction 16. The holes (not shown) produced by the drilling may receive screws or pins to fix the position of the laterally adjustable member 12 relative to the base member 14.

The optics mount 10 may also include a scope bracket 22 that has a first bracket member 24, a second bracket member 26 and scope bracket screws 28. In one embodiment (not shown), the scope bracket 22 is selectively attachable to the optics mount 10. The scope bracket screws 28 are used to secure the first bracket member 24 to the second bracket member 26 and apply a compression force to a scope 78 (illustrated, for example, in FIG. 3A) positioned therein to limit movement of the scope 78 relative to the scope bracket 22. The scope bracket 22 shown in FIG. 1 is merely illustrative. The optics mount 10 may include, for example, multiple brackets (or bands) for securing a scope 78 or may include brackets configured in a manner different than the bracket 22 shown in FIG. 1.

The base member 14 may be secured to a firearm 70 (illustrated, for example, in FIG. 3A), as will be explained subsequently in connection with FIGS. 3A-3C. The base member 14 includes a compression opening 43 disposed intermediate a first compression side 38 and a second compression side 39. The base member 14 also includes a side rail receptor 60 that enables engagement with a firearm 70.

A compression mechanism 40 is utilized to draw the second compression side 39 toward the first compression side 38, thus narrowing the compression opening 43 and applying a compression force to a side rail male member 76 (illustrated, for example, in FIG. 3A) disposed within the side rail receptor 60. As illustrated, the side rail receptor 60 has a female dovetail shape, while the side rail male member 76 has a male dovetail shape that enables slidable engagement between the side rail receptor 60 and the side rail male member 76 of the side rail mount 75 (illustrated, for example, in FIG. 3A).

The rear stop pin 62 engages the side rail mount 75 to limit the sliding movement of the side rail receptor 60 relative to the side rail mount 75. In one embodiment, the rear stop pin 62 may be selectively removable or adjustable in height and could comprise, for example, a cylindrical pen, a screw or other threaded member.

The compression mechanism 40 includes a compression screw 42 and a rotating arm 44. The rotating arm 44 includes a body 46 and an angled member 48. The rotating arm 44 selectively engages the compression screw 42 and provides leverage to enable forceful rotation of the compression screw 42. The angled member 48 is angled with respect to the body 46 and enables easy grasping and manipulation of the rotating arm 44. In one embodiment, as illustrated in FIG. 1, the angled member 48 is perpendicular to the body 46.

The body 46 may also include an extension member 50 that interfaces with an extension opening 52 in the base member 14. The extension member 50 may be positioned within the extension opening 52 to limit rotation of the rotating arm 44 such that the rotating arm 44 remains in a stowed position 41, as illustrated in FIGS. 2A-2D. In the stowed position 41, the rotating arm 44 is unlikely to interfere with the user's operation of the firearm 70.

Figures 2A, 2B, 2C:
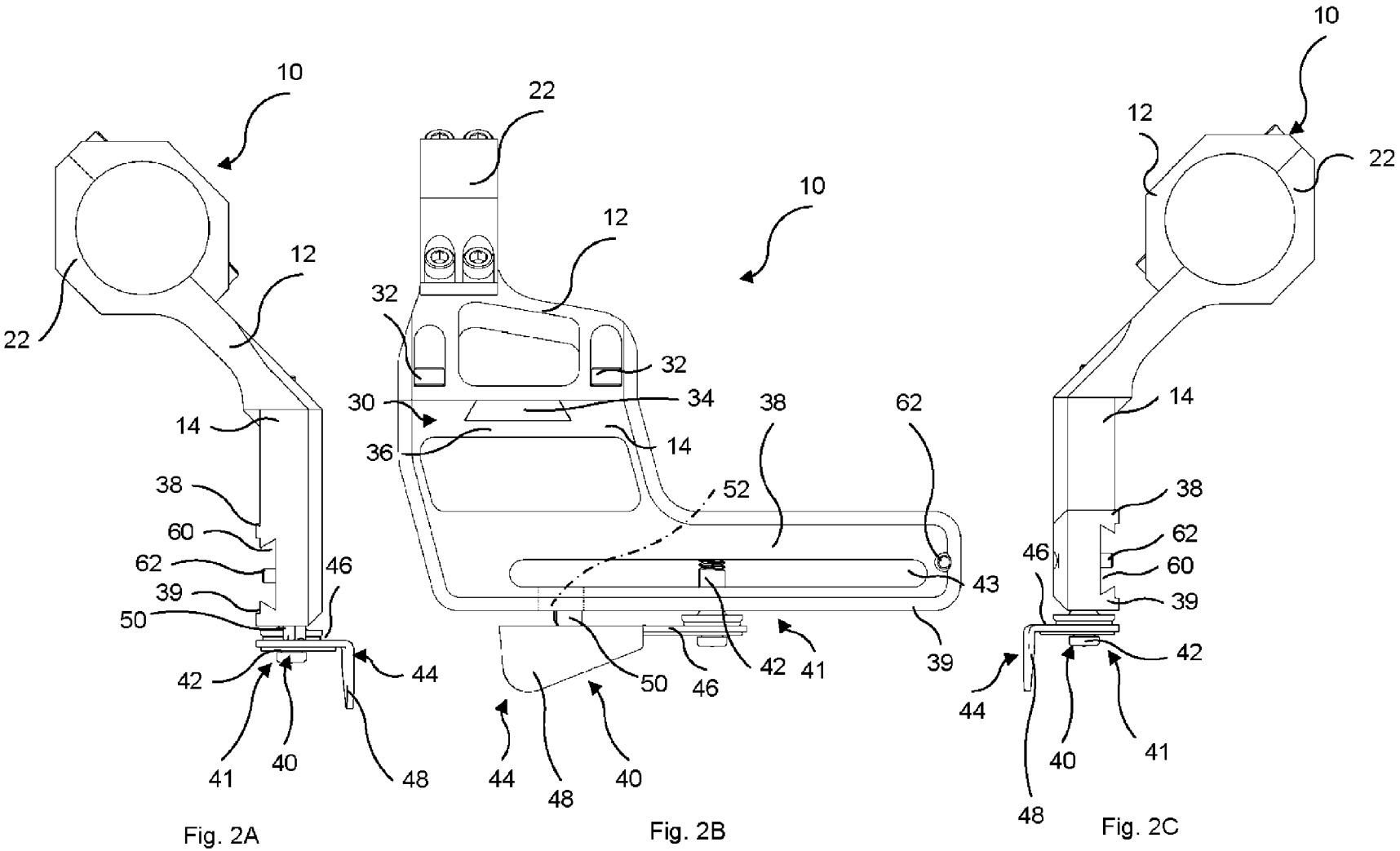
FIGS. 2A, 2B, 2C, and 2D illustrate a front view, a first side view, a rear view, a second side view, respectively, of the optics mount shown in FIG. 1.
Figure 2D:
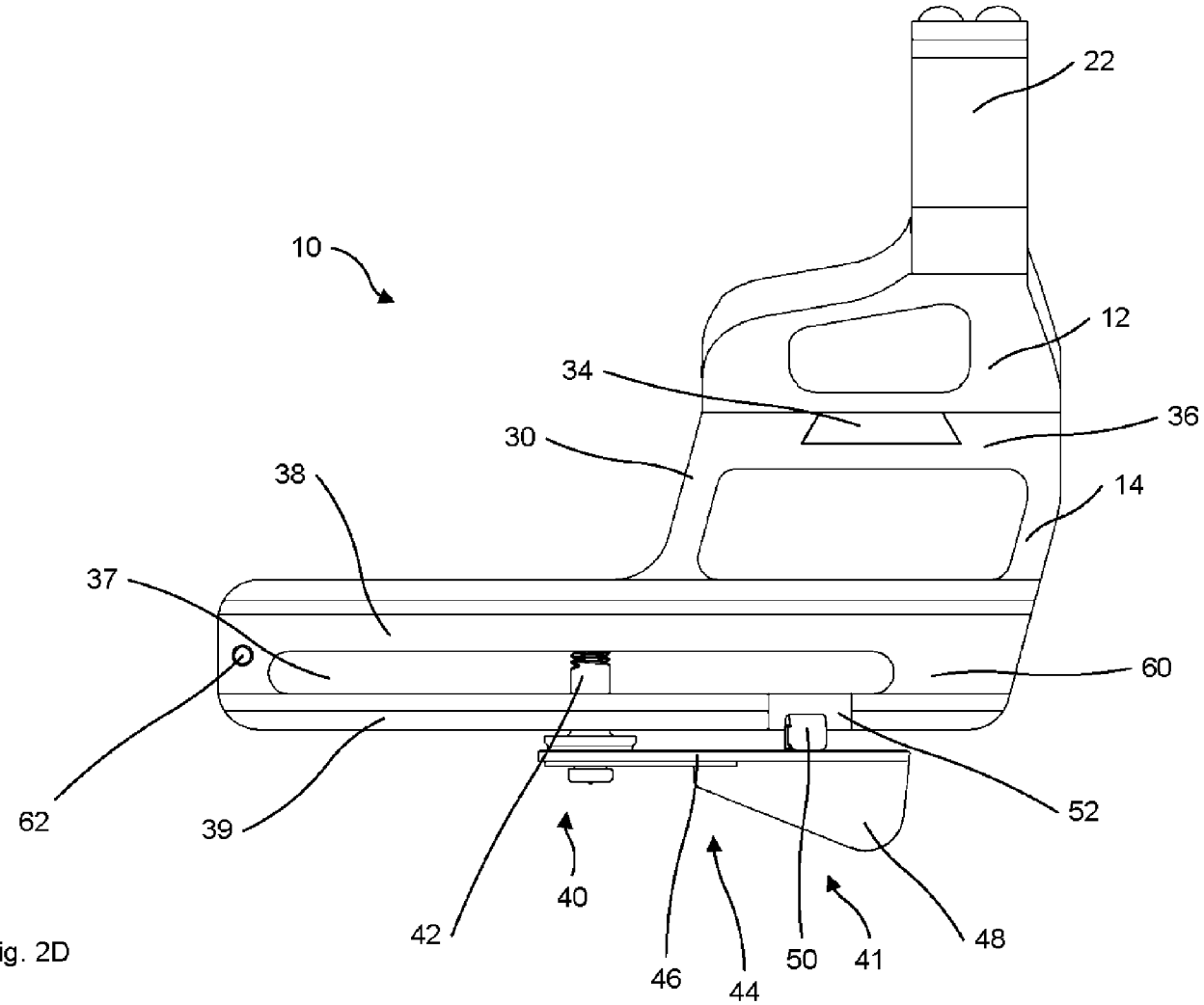

Referring now to FIGS. 2A-2D, FIG. 2A is a front view of the embodiment of the optics mount 10 of FIG. 1; FIG. 2B is a first side view (a view of the side of the optics mount 10 opposite the firearm 70 when the optics mount 10 is secured to the firearm 70, as illustrated in FIG. 3C) of the embodiment of the optics mount 10 of FIG. 1; FIG. 2C is a rear view of the embodiment of the optics mount 10 of FIG. 1; and FIG. 2D is a second side view (a view of the side of the optics mount 10 adjacent to the firearm 70 when the optics mount 10 is secured to the firearm 70, as illustrated in FIG. 3C) of the embodiment of the optics mount 10 of FIG. 1. It should be noted that the foregoing views (i.e., front, rear, and side views) are based upon orientation of the optics mount 10 secured to a firearm 70 as illustrated in FIG. 3C. An alternative embodiment of the optics mount may be, for example, a mirror image of the optics mount 10 illustrated in FIG. 1 (e.g., the optics mount 10 could be configured to be mounted on the right side of the firearm 70 as illustrated in FIG. 3C).

FIGS. 2A-2D illustrate front, side, and rear views of the laterally adjustable member 12 and base member 14. As explained previously, the laterally adjustable member 12 includes a scope bracket 22 and a male dovetail member 34 that slidably interfaces with a female dovetail member 36 of the base member 14. The male dovetail member 34 and the female dovetail member 36 comprise the interlocking mechanism 30 and enable adjustment of the laterally adjustable member 12 relative to the base member 14 in a lateral direction 18. The lateral direction locking screws 32 may be tightened to fix the position of the laterally adjustable member 12 relative to the base member 14.

As discussed previously, the compression mechanism 40 may be utilized to pull the second compression side 39 towards the first compression side 38, narrowing the compression opening 43 and compressing the side rail receptor 60 to frictionally engage the side rail male member 76 of the side rail mount 75 (illustrated in FIG. 3A) of a firearm 70. The rear stop pin 62 limits the sliding movement of the side rail receptor 60 relative to the side rail mount 75.

The compression mechanism 40 includes the compression screw 42, and the rotating arm 44 that selectively engages the compression screw 42 to enable rotation of the compression screw 42 to induce the compression of the compression mechanism 40 or, alternatively, to release the compression by rotating the compression screw 42 in an opposite direction. As stated previously, the rotating arm 44 includes a body 46, an angled member 48, and an extension member 50. The extension member 50 may be positioned within the extension opening 52 when the rotating arm 44 is in a stowed position 41, as illustrated in FIGS. 2A-2C.

Figure 3A:
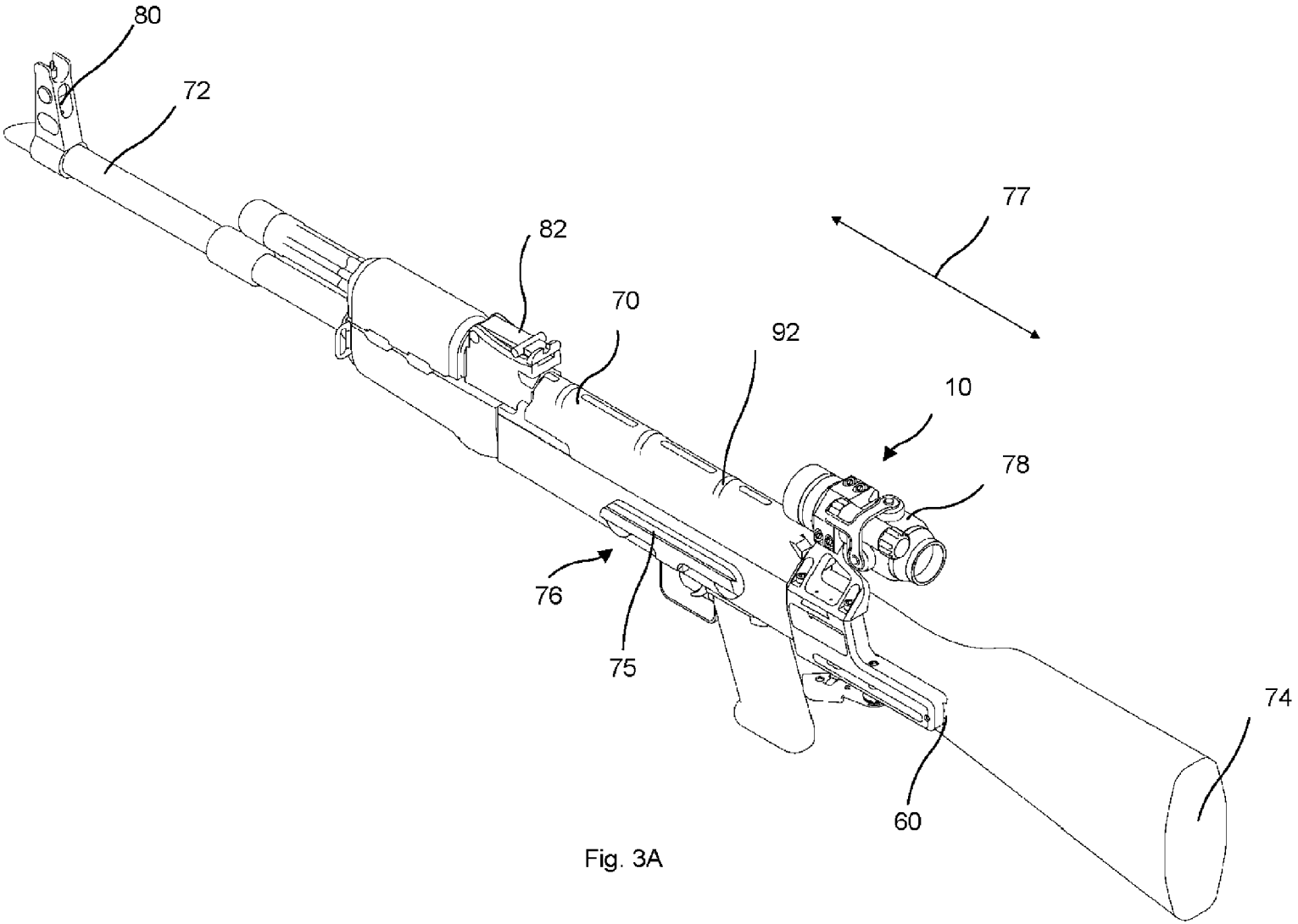
FIG. 3A is an elevated perspective view of a firearm shown together with the embodiment of the optics mount of FIG. 1 in a pre-engagement position.

FIG. 3A is an elevated perspective view of a firearm 70 shown together with the embodiment of the optics mount 10 of FIG. 1 in a pre-engagement position. The illustrated firearm 70 (in this case, a rifle-style firearm 70) includes a barrel 72, a butt 74, a front sight 80, a rear sight 82, a longitudinal direction 77, and a dust cover 92. The firearm 70 also includes a side rail mount 75 comprising a side rail male member 76 having a dovetail shape. A scope 78 is positioned within the optics mount 10, as shown in FIG. 1. As illustrated (in a pre-engagement position), the optics mount 10 is positioned near the side rail mount 75 as the mount 10 would be when moved in a longitudinal direction 77 (in a direction from the butt 74 toward the barrel 72 of the firearm 70) prior to the side rail receptor 60 of the mount 10 engaging the side rail male member 76. The side rail mount 75 may be integrally formed with the firearm 70 or a portion of the firearm 70 or may simply be secured to the firearm 70.

Figure 3B:
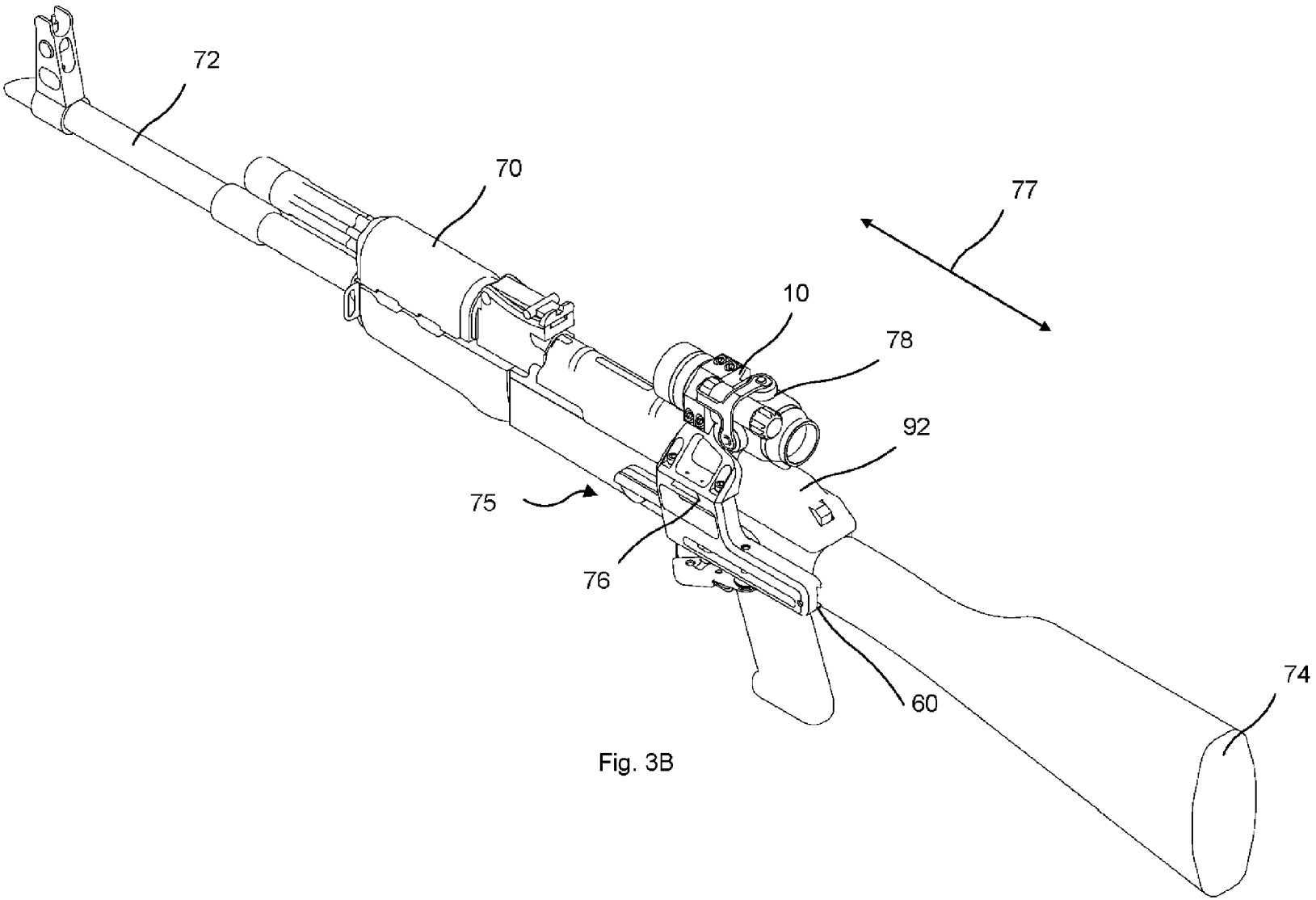
FIG. 3B is an elevated perspective view of the embodiment of the optics mount of FIG. 1 shown in a partially engaged position with a firearm.

FIG. 3B is an elevated perspective view of the embodiment of the optics mount 10 of FIG. 1 shown in a partially engaged position with a firearm 70. In FIG. 3B, the side rail receptor 60 has engaged the side rail male member 76 of the side rail mount 75.

Figure 3C:
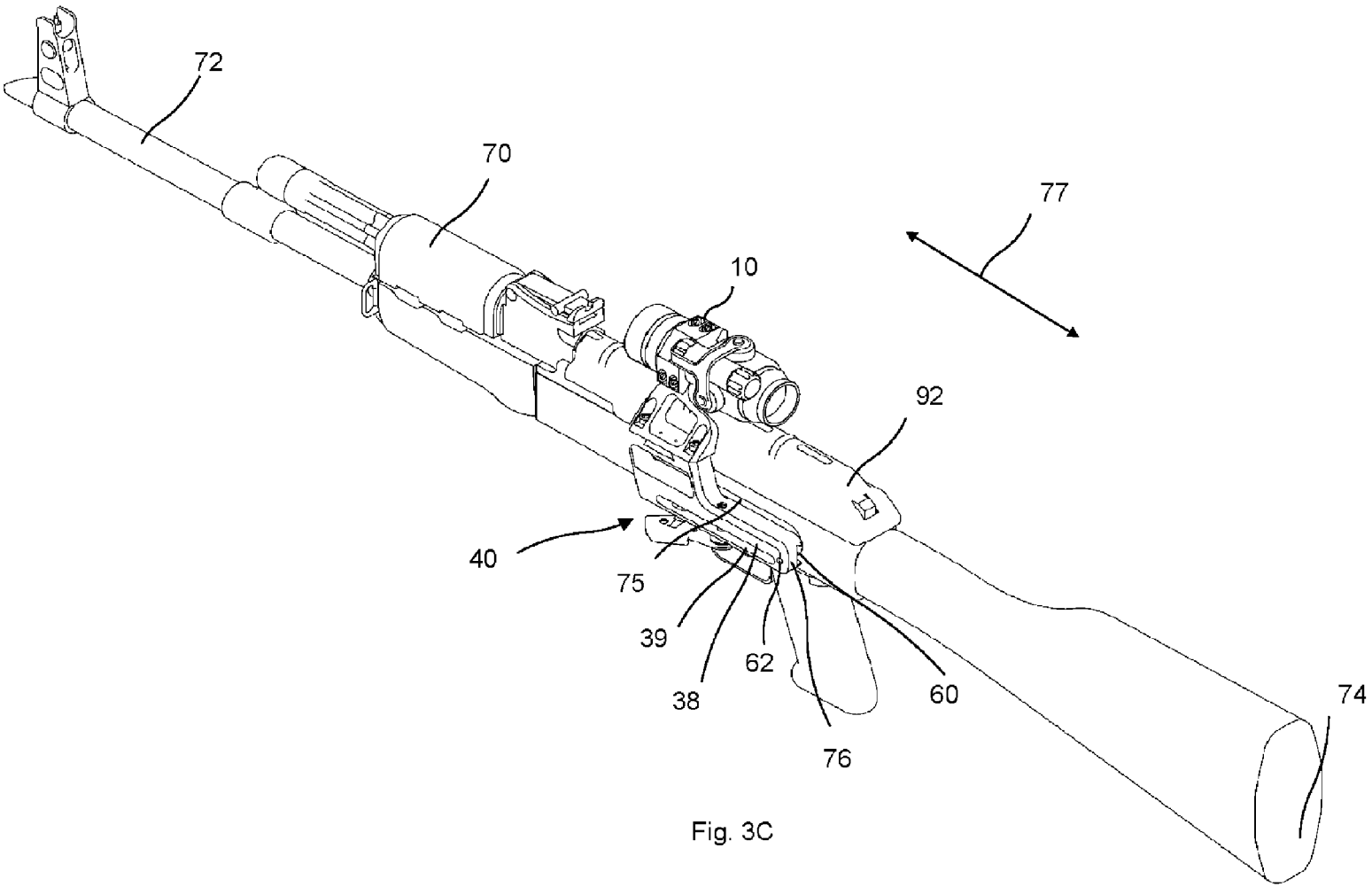
FIG. 3C illustrates the embodiment of the optics mount of FIG. 1 shown in a fully engaged position with a firearm.

FIG. 3C illustrates the embodiment of the optics mount 10 of FIG. 1 in a fully engaged position with a firearm 70. In particular, in this figure, the side rail receptor 60 has been directed on to the side rail male member 76 of the side rail mount 75 until the rear stop pin 62 contacts, or nearly contacts, the side rail mount 75. In this state, the compression mechanism 40 may be utilized to pull the second compression side 39 toward the first compression side 38, causing the side rail receptor 60 to compress and frictionally engage the side rail male member 76 and limit movement of the optics mount 10 relative to the firearm 70.

Figure 4B:
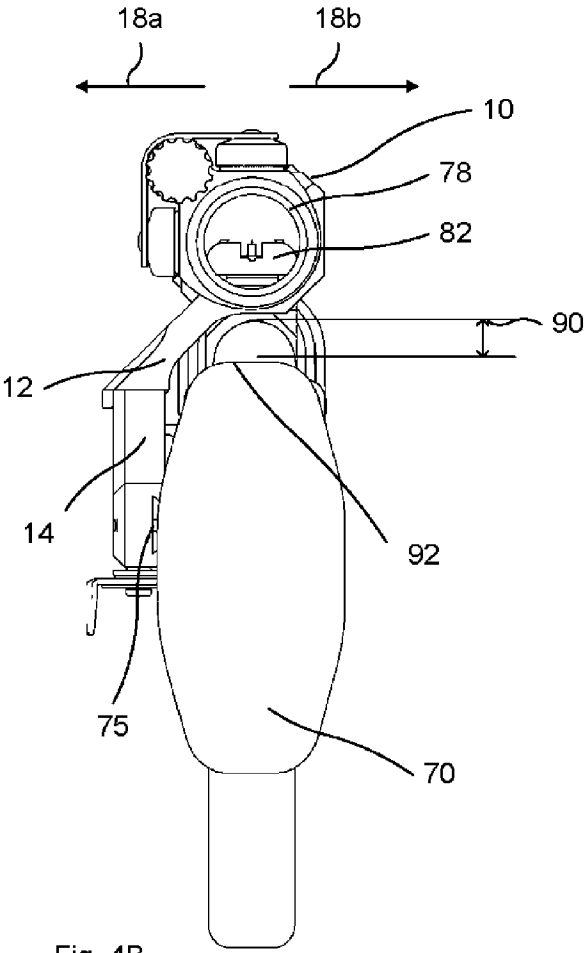
FIGS. 4A and 4B illustrate lateral movement of a laterally adjustable member of the embodiment of the optics mount of FIG. 1 in connection with over bore co-witnessing.
Figure 4A:
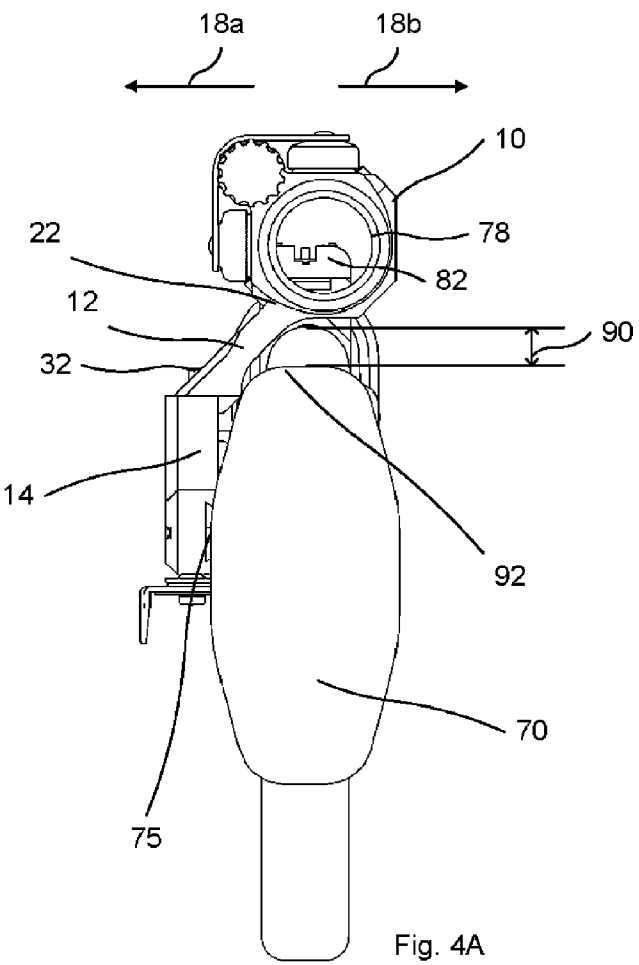

FIGS. 4A and 4B illustrate lateral movement of a laterally adjustable member of the embodiment of the optics mount 10 of FIG. 1 to achieve over bore co-witnessing. FIGS. 4A and 4B illustrate rear views of the optics mount of FIG. 1 positioned on the firearm 70 illustrated in FIGS. 3A-3C. As explained previously, the base member 14 is secured to the firearm 70 utilizing the side rail mount 75. As illustrated in FIG. 4A, the scope 78 is not centered (co-witnessed) with respect to the rear sight 82 and also the front sight 80 (illustrated in FIG. 3A, but not visible in FIG. 4A) of the firearm 70. As discussed previously, the laterally adjustable member 12 may be adjusted in a first or a second lateral direction 18*a-b*. Thus, as illustrated in FIG. 4B, the laterally adjustable member 12 has been adjusted in a second lateral direction 18*b* to center or co-witness the scope 78 relative to the rear sight 82 and the front sight 80. Once over bore co-witnessing is achieved (as illustrated in FIG. 4B), the lateral direction locking screws 32 may be tightened to fix the position of the laterally adjusting member 12.

As illustrated in FIGS. 4A and 4B, there is a space 90 intermediate the scope bracket 22 and the firearm 70. For example, in one embodiment, this space 90 is approximately 0.125 inches. In certain embodiments, the space 90 may be at least 0.25 inches or, alternatively, equal to or less than 0.25 inches. This space 90 enables a field strip (e.g., removal of the dust cover 92, removal of the recoil spring and guide rod, and removal of the bolt carrier and bolt) of the firearm 70 without removing the optics mount 10.

Figure 5:
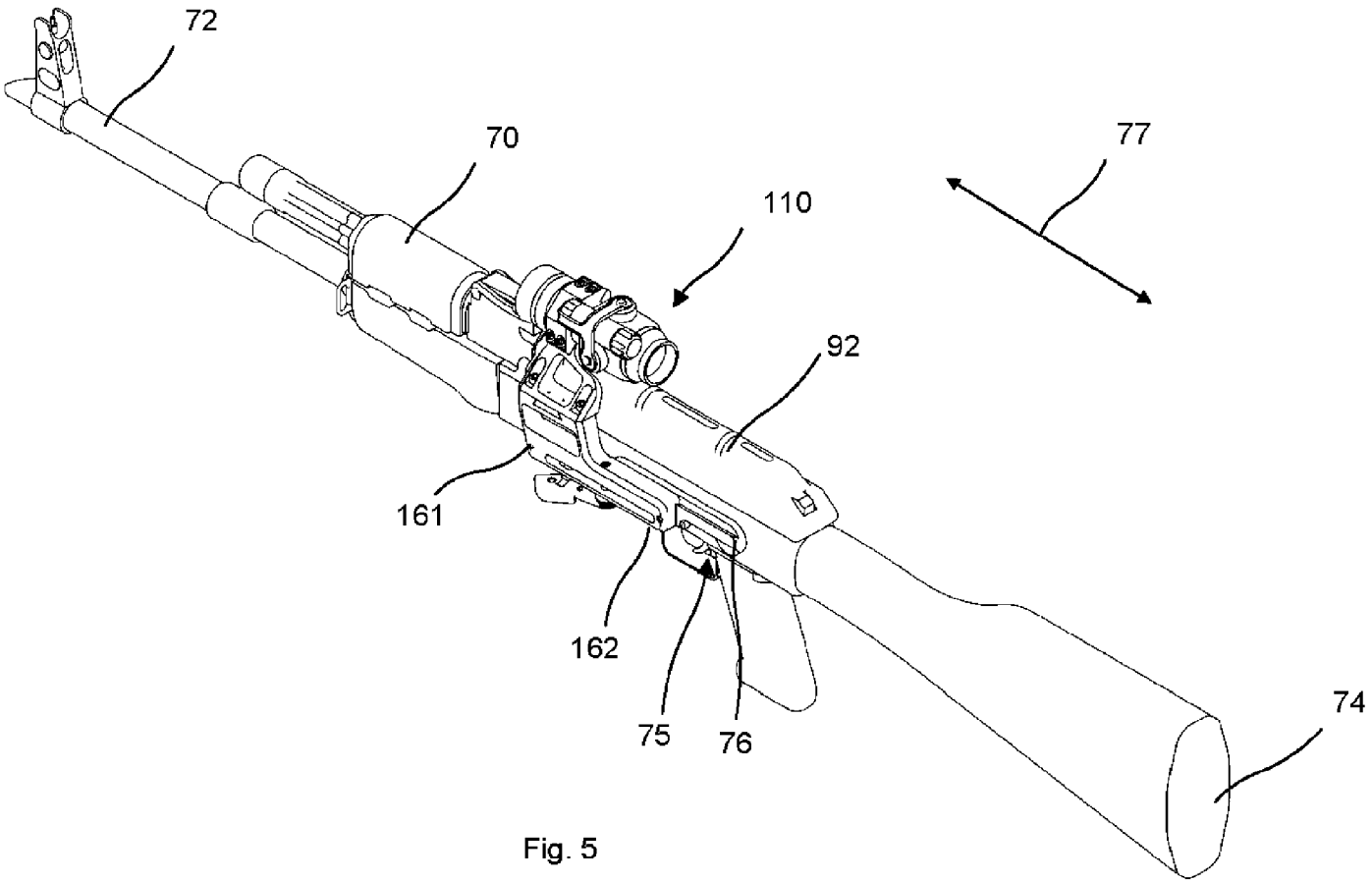
FIG. 5 illustrates an alternative embodiment of an optics mount shown in a partially engaged position with a firearm.

FIG. 5 illustrates an alternative embodiment of an optics mount 110 shown in a partially engaged position with a firearm 70. As the embodiment illustrated in FIGS. 3A-3C, the firearm 70 includes a barrel 72, a butt 74, and a longitudinal direction 77. A side rail mount 75 includes a side rail male member 76

This alternative embodiment of the optics mount 110 includes a front stop pin 161. The rear stop pin 62 (shown, for example, in FIG. 2C) has been removed leaving only a rear stop pin opening 162. In one embodiment (not shown), the rear stop pin opening 162 and rear stop pin 62 are omitted. The front stop pin 161 limits the movement of the optics mount 110 as it is slidably secured to the side rail male member 76 of the side rail mount 75 moving in the longitudinal direction 77 from the barrel 72 toward the butt 74 of the firearm 70.

The disclosed optics mount 10/110 provides a number of advantages. For example, the disclosed optics mount 10/110 enables over bore co-witnessing while also allowing a field strip of the firearm 70 without removing the optics mount 10/110 from the firearm 70.

Figure 7:
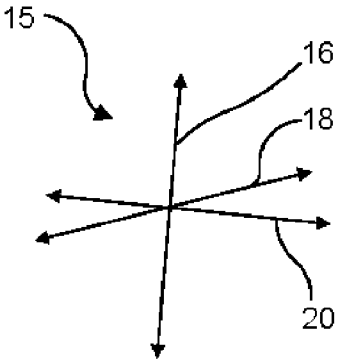
FIG. 7 is a perspective view of one embodiment of an optics mount shown together with a directional key.
Figure 7:
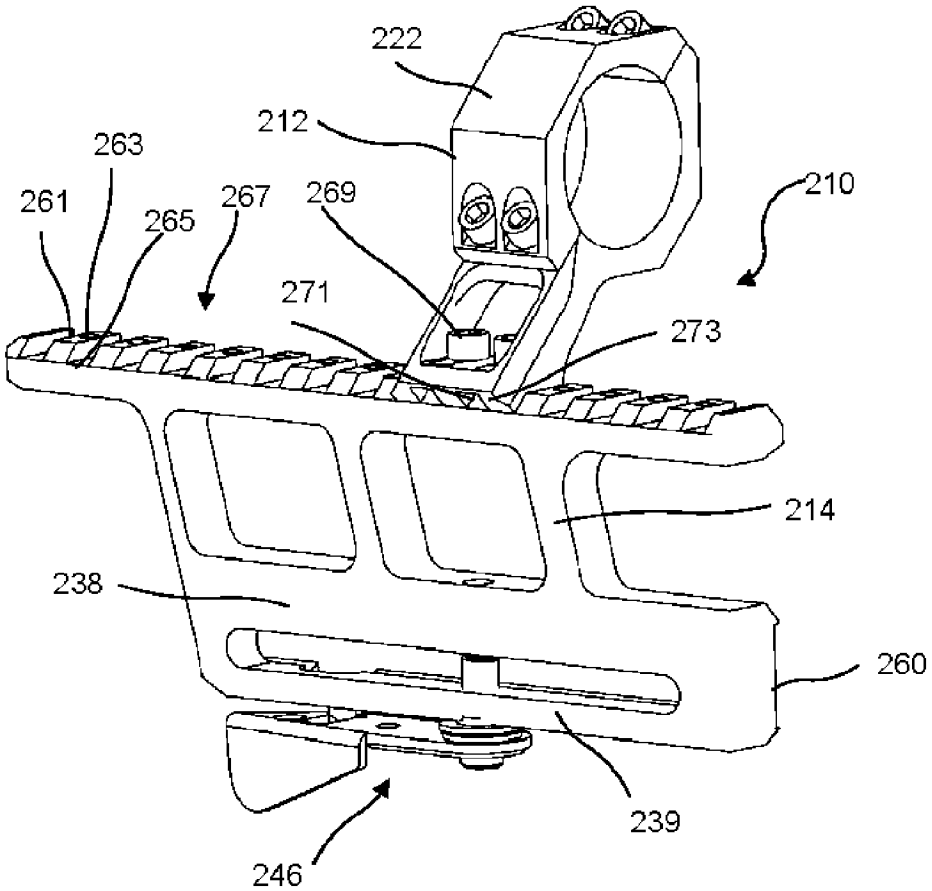

FIG. 7 is a perspective view of an alternative embodiment of an optics mount 210. A directional key 15 is also shown in FIG. 7. The optics mount 210 illustrated in FIG. 7 includes an adjustable member 212 and a base member 214. The illustrated optics mount 210 enables adjustment of the adjustable member 212 relative to the base member 214 in both a lateral direction 18 and in a longitudinal direction 20.

In this embodiment, the adjustable member 212 includes a scope bracket 222 and the adjustment screws 269. The adjustable member 212 may also include one or more adjustable member extensions 273 with adjustable member intermediary gaps 271. The number of adjustable member extensions 273 and adjustable member intermediary gaps 271 may be varied within the scope of the disclosed subject matter.

The base member 214 may include a side rail receptor 260. The base member 214 also includes a first compression side 238 and a second compression side 239 that may be drawn towards each other using a compression mechanism 246, as explained above. Accordingly, using the side rail receptor 260, the first compression side 238, the second compression side 239, and the compression mechanism 246, the base member 214 may be secured to a firearm 70. Other arrangements may be incorporated into the optics mount 210 to allow the optics mount 210 to be secured to a firearm 70.

The base member 214 may also include a row 267 of base extensions 261 with base member intermediary gaps 265. The number of base extensions 261 and base member intermediary gaps 265 may be varied within the scope of the disclosed subject matter. Each of the base extensions 261 may include one or more base opening 263. The base openings 263 may be sized to securely receive the adjustment screws 269 of the adjustable member 212.

The adjustable member extensions 273 and the adjustable member intermediary gaps 271 mate with the base extensions 261 and base member intermediary gaps 265 such that the adjustable member 212 slidably engages with the base member 214. The sliding engagement enables the adjustable member 212 to slide relative to the base member in a lateral direction 18 while minimizing or eliminating rotation or movement of the adjustable member 212 (depending manufacturing precision and tolerances) in a longitudinal direction 20. Accordingly, in one embodiment, there is a contact or a near contact mating engagement between the base extensions 261 and base member intermediary gaps 265 with the adjustable member extensions 273 and the adjustable member intermediary gaps 271.

Figure 8:
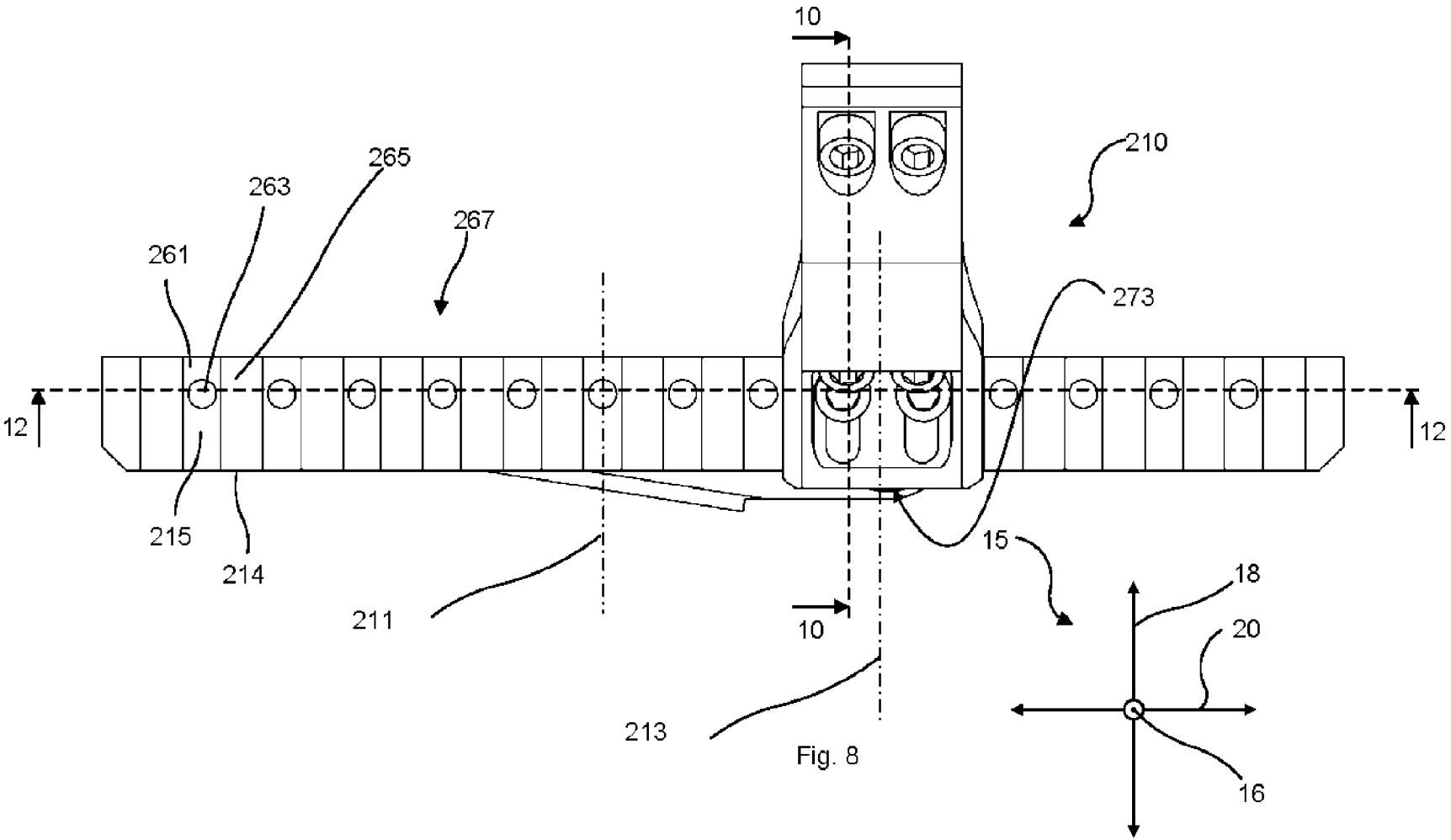
FIG. 8 is a top view of the optics mount illustrated in FIG. 7 shown together with a directional key.

FIG. 8 provides a top view of the optics mount 210 together with a directional key 15. In one embodiment, the longitudinal direction 20 of the optics mount 210 extends along the longest dimension of the base member 214 when seen from the top view (which is illustrated in FIG. 8). In one embodiment, the lateral direction 18 extends along the narrowest dimension of the base member 214 when seen from the top view. In one embodiment, the transverse direction 16 is perpendicular to both the lateral direction 18 and the longitudinal direction 20, the lateral direction 18 and the longitudinal direction 20 also being mutually perpendicular. As illustrated in FIG. 8, the transverse direction 16 is perpendicular to the surface 215 of a base extension 261.

FIG. 8 illustrates an embodiment of a row 267 of base extensions 261 and base member intermediary gaps 265. In the illustrated embodiment, each of the base extensions 261 and base member intermediary gaps 265 are equal in width. The base extensions 261 and the base member intermediary gaps 265 are arranged in a row in a longitudinal direction 20. In the illustrated embodiment, each of the base extensions 261 includes a base opening 263. As illustrated in FIG. 8, a longitudinal axis 211 of each base extension 261 extends in a lateral direction 18. The longitudinal axis 213 of the adjustable member extensions 273 also extends in a lateral direction 18.

Figure 9B:
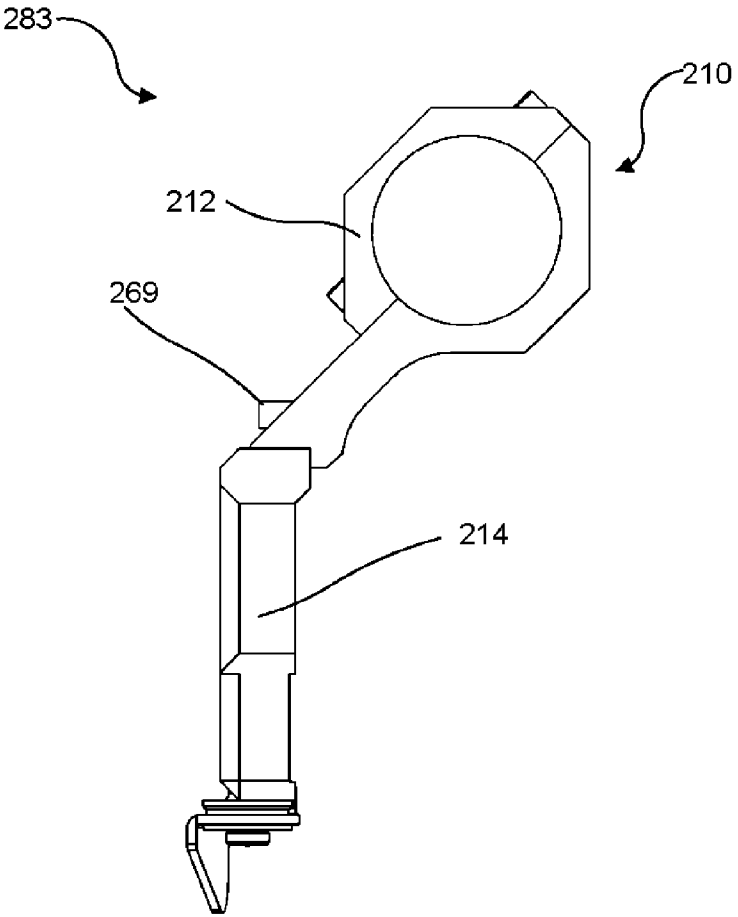
FIGS. 9A-B illustrate front views of the optics mount of FIG. 7 with the adjustable member situated in different positions in a lateral direction shown together with a directional key.
Figure 9A:
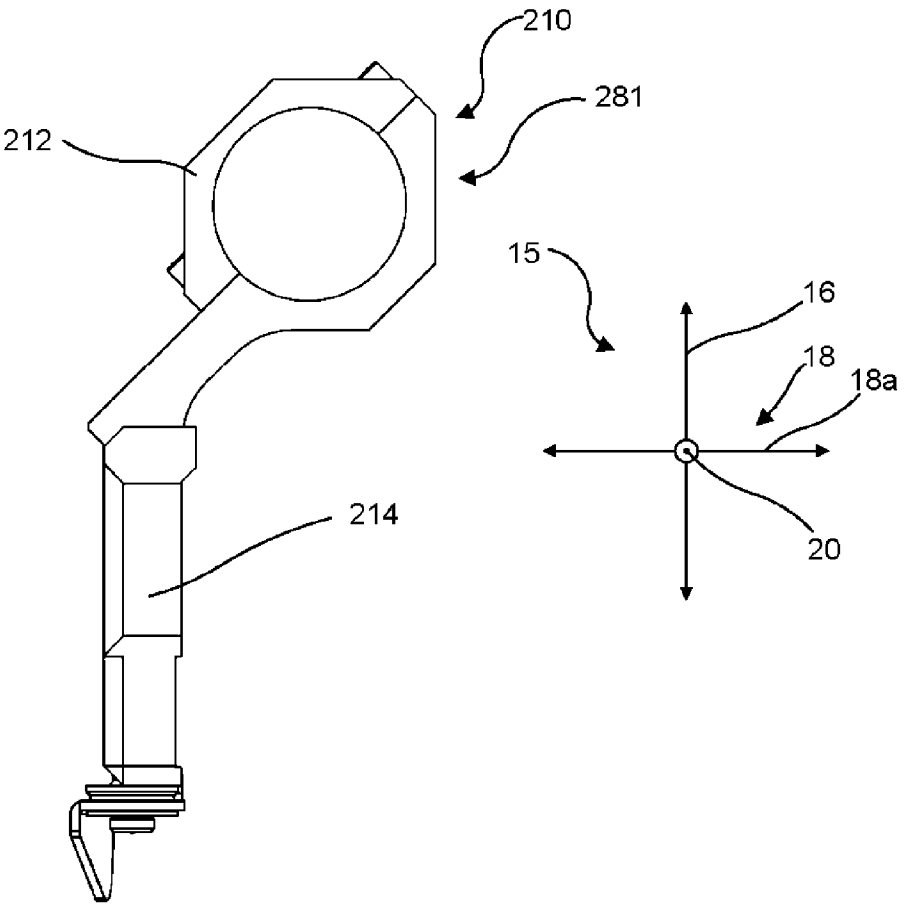

FIGS. 9A-B each illustrate a front view of the optics mount 210. FIG. 9A also includes a directional key 15. The directional key 15 is oriented such that it may also be utilized in connection with FIG. 9B. FIGS. 9A-B illustrate that the adjustable member 212 may be adjusted in a lateral direction 18 relative to the base member 214. In particular, the adjustable member 212 is in a first lateral position 281 in FIG. 9A. In FIG. 9B, the adjustable member 212 has been moved in a first lateral direction 18*a* and is positioned in second lateral position 283. Accordingly, by loosening and re-tightening the adjustment screws 269, the adjustable member 12 may be moved in a first lateral direction 18*a* and secured in a new lateral position 283.

Figure 10:
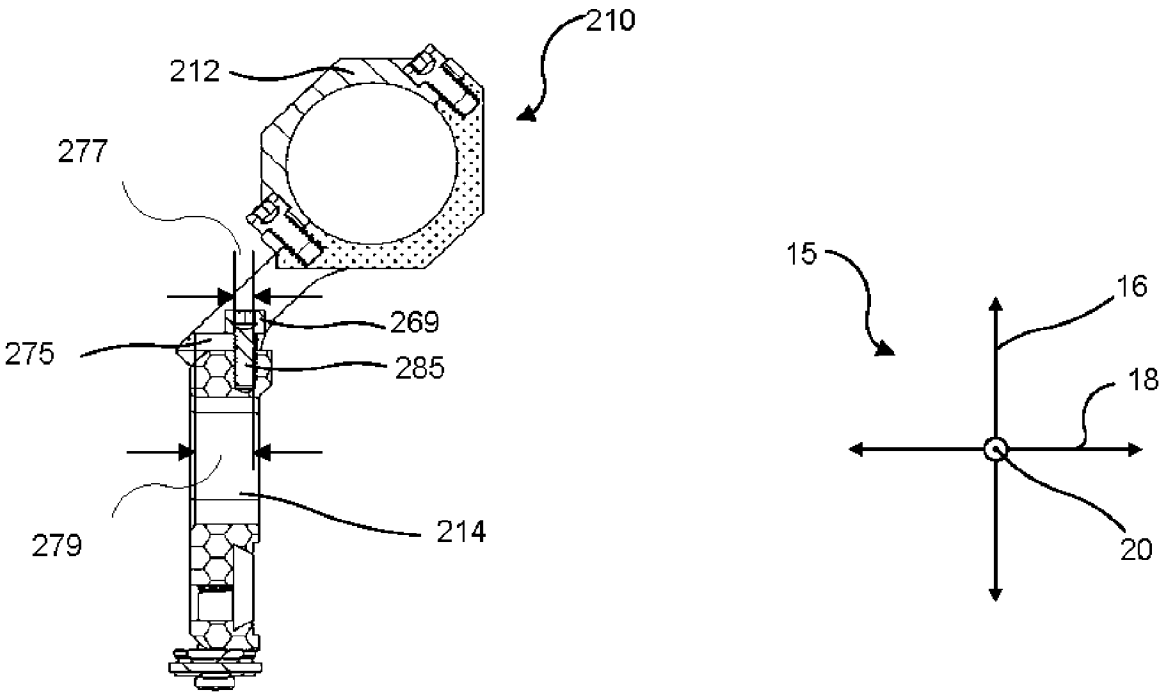
FIG. 10 is a cross-sectional view of the optics mount shown across the line 10-10 of FIG. 8 shown together with a directional key.

FIG. 10 is a cross-sectional view of the optics mount across the line 10-10 of FIG. 8 shown together with the directional key 15. The cross-sectional view of FIG. 10 illustrates that the adjustable member 212 includes an adjustment slot 275. The width 279 of the adjustment slot 275 is greater than the width 277 of the body 285 (e.g., the threaded portion) of the adjustment screw 269. Accordingly, it is the width 279 of the adjustment slot 275 relative to the width 277 of the body 285 of the adjustment screw 269 that enables adjustment and movement of the adjustable member 212 in a lateral direction 18 relative to the base member 214.

Figure 11B:
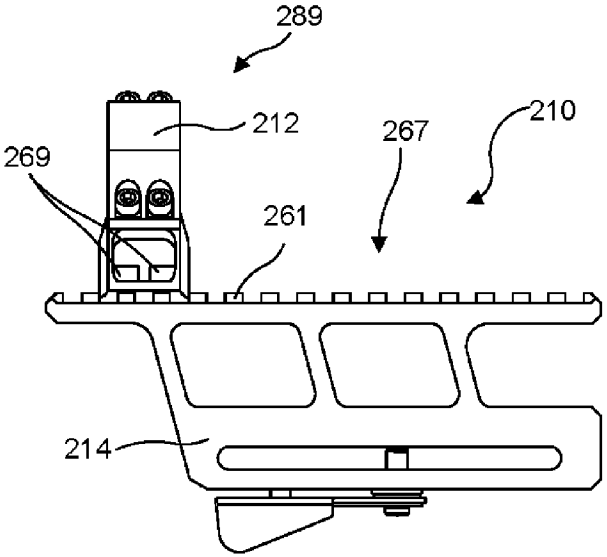
FIGS. 11A-B illustrate side views of the optics mount of FIG. 7 with the adjustable member situated in different positions in a longitudinal direction shown together with a directional key.
Figure 11A:
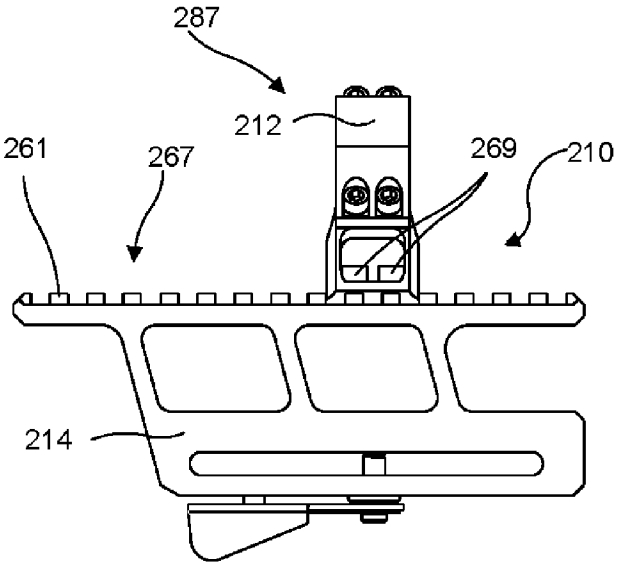
Figure 11A:
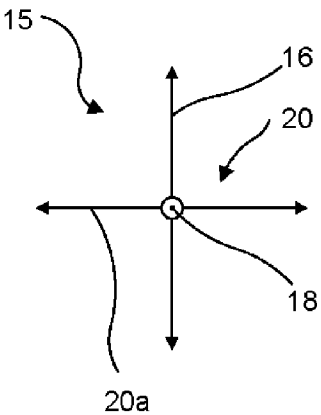

FIGS. 11A-B illustrate a side view of the optics mount 210. In particular, FIGS. 11A-B illustrate the adjustable member 212 in a first longitudinal position 287 (FIG. 11A) and a second longitudinal position 289 (FIG. 11B). A key 15 is also illustrated in connection with FIG. 11A. The key 15 is oriented such that it may also be utilized in connection with FIG. 11B.

As illustrated in FIGS. 11A-B, the base member 214 may include a row 267 of base extensions 261 with which the adjustable member 212 may interface. Accordingly, as illustrated in FIG. 11A, the adjustable member 212 may be in a first position 287 relative to the base member 214. The adjustment screws 269 may thereafter be loosened to enable the adjustable member 212 to be separated from the base member 214. The adjustable member 212 may thereafter be moved in a first longitudinal direction 20*a* along the row 267 of base extensions 261 of the base member 214. Thereafter, the adjustable member 212 may be secured to the base member 214 at a second position 289 along the row 267 of base extensions 261, as illustrated in FIG. 11B.

Figure 12:
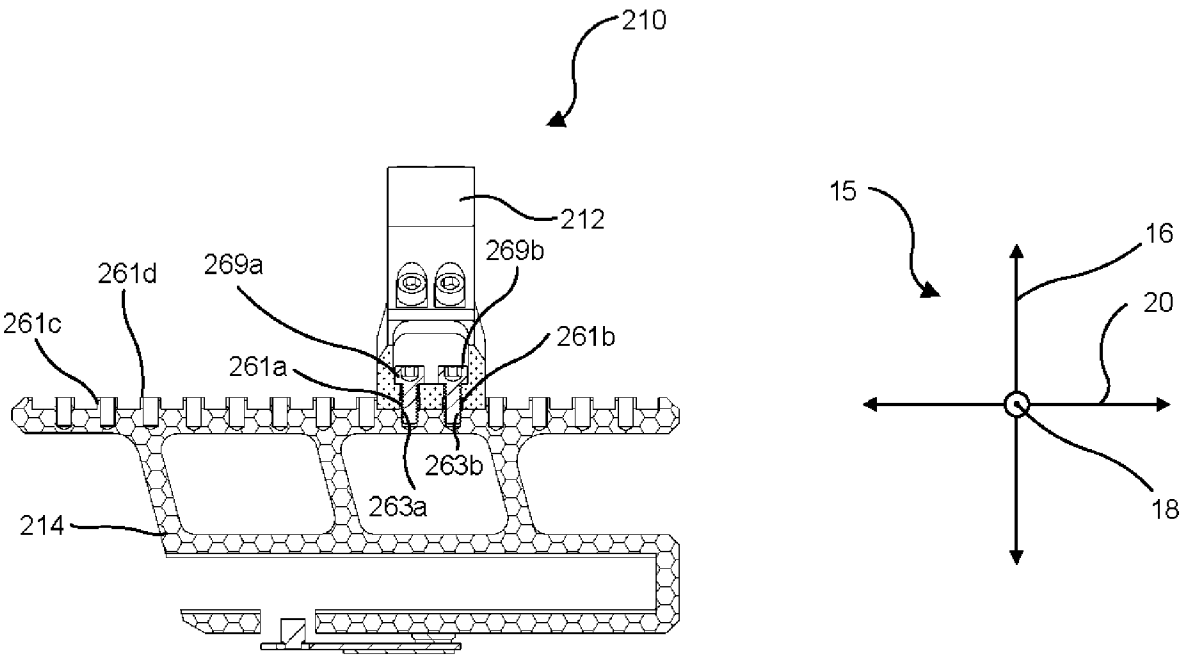
FIG. 12 is a cross-sectional view of the optics mount shown in FIG. 8 across the line 12-12 shown together with a directional key.

FIG. 12 is a cross-sectional view of the optics mount 210 along the line 12-12 of FIG. 8 shown together with a key 15. As illustrated in FIG. 12, a first adjustment screw 269*a* is positioned within a first base opening 263*a* of a first base extension 261*a*. In addition, a second adjustment screw 269*b* is positioned within a second base opening 263*b* of a second base extension 261*b*. Thereafter, the first and second adjustment screws 269*a-b* may be removed from the first and second base openings 263*a-b*, and the adjustable member 212 may be repositioned and secured, for example, to a third and fourth base extensions 261*c-d* on the base member 214. Accordingly, the adjustable member 212 may be unsecured from the base member 214 and re-secured to the base member 214 at a different position in a longitudinal direction 20.

In one embodiment, an adjustable member extension 273 may be referred to as an engaging member, a male engaging member, or an adjustable male engaging member. A base extension 261 may be referred to as an engaging member, a male engaging member, or a base male engaging member. A dovetail member 34, male member 234 or male member 334 may each also be referred to as an engaging member, a male engaging member, or an adjustable or base male engaging member.

An adjustable member intermediary gap 271 may be referred to as an engaging member, a female engaging member, or an adjustable female engaging member. A base member intermediary gap 265 may be referred to as an engaging member, a female engaging member, or a base female engaging member. The dovetail member 36, female member 236 or female member 336 may each also be referred to as an engaging member, a female engaging member, or an adjustable or base female engaging member.

While specific embodiments and applications of the present invention have been illustrated and described, it is to be understood that the invention is not limited to the precise configuration and components disclosed herein. Various modifications, changes, and variations, which will be apparent to those skilled in the art, may be made in the arrangement, operation, and details of the methods and systems of the present invention disclosed herein without departing from the spirit and scope of the invention.

What is claimed is:

1. An optics mount for a firearm comprising:

a laterally adjustable member comprising a first engaging member and a scope bracket, the scope bracket having a center, the center of the scope bracket being equidistant from opposite ends of the scope bracket along a lateral direction, the lateral direction comprising a first lateral direction and a second lateral direction, the first lateral direction being opposite the second lateral direction; and a base member comprising a second engaging member and a side rail receptor shaped to slidably engage a side rail mount of a firearm, the base member having a center, the center of the base member being equidistant from opposite ends of the base member along the lateral direction, wherein the first engaging member and second engaging member are shaped and oriented to allow lateral adjustment of the laterally adjusting member relative to the base member in the first lateral direction and the second lateral direction, the base member comprising a first side and a second side, the first side being opposite the second side along the lateral direction, the side rail receptor being disposed on the second side of the base member, the first lateral direction extending away from the first side and the second lateral direction extending away from the second side, wherein the laterally adjustable member extends away from the base member such that the center of the scope bracket is offset from the center of the base member in the second lateral direction.

2. The optics mount of claim 1, wherein the base member further comprises a plurality of engaging members arranged in a row.

3. The optics mount of claim 2, wherein the laterally adjustable member may be selectively unsecured and re-secured to one or more engaging members of the base member to enable longitudinal adjustment of the laterally adjustable member relative to the base member.

4. The optics mount of claim 3, wherein a longitudinal axis of the second engaging member extends in the lateral direction.

5. The optics mount of claim 3, wherein a longitudinal axis of the first engaging member extends in the lateral direction.

* * * * *